US005263270A

United States Patent [19]

Strauss

[11] Patent Number: 5,263,270

[45] Date of Patent: Nov. 23, 1993

[54] CASE FOR VISUALLY DISPLAYING A FLAG IN A REALISTIC MANNER

[76] Inventor: Robert S. Strauss, 8254 Griffin Rd., Davie, Fla. 33328

[21] Appl. No.: 48,284

[22] Filed: Apr. 14, 1993

[51] Int. Cl.[5] ..... G09F 17/00

[52] U.S. Cl. ..... 40/218; 40/427

[58] Field of Search ..... 40/218, 427, 429, 439, 40/412, 411; 446/178, 217, 218, 199, 176

[56] References Cited

U.S. PATENT DOCUMENTS

| | | | |
|---|---|---|---|
| 1,725,250 | 8/1929 | Burgess | 40/218 |
| 1,777,933 | 10/1930 | O'Brien | 40/218 |
| 2,619,349 | 11/1952 | Abrahamson | 40/218 |
| 3,798,816 | 3/1974 | Flaherty | 40/218 |
| 4,879,145 | 11/1989 | McLellan et al. . | |
| 4,998,364 | 3/1991 | Sengstaken . | |
| 5,056,657 | 10/1991 | Frye . | |
| 5,070,809 | 12/1991 | Fox et al. . | |

*Primary Examiner*—James R. Brittain
*Assistant Examiner*—Cassandra Davis
*Attorney, Agent, or Firm*—Leslie J. Lott & Associates

[57] ABSTRACT

A case of visually displaying a flag in a realistic manner which provides an illusion that the flag is kept aloft in the wind with the sun in the background. The case comprises a box having an elongated, flat, substantially rectangular front panel constructed from a substantially opaque material and including a substantially transparent viewing section positioned substantially in the center of the front panel; a flag pole mounted within the box to an elongated, flat, substantially rectangular base panel having a first end and a second end opposite one another; a flag attached to the flag pole and positioned so as to be visible through the transparent viewing section of the front panel; and an interior frame comprising an interior side panel mounted to the base panel of the frame and having an opening positioned at substantially the same height as the positioning of the flag on the flagpole; an interior cover panel mounted to the interior side panels; and a fan mounted to the interior side panel of the interior frame and positioned at substantially the same height as the opening of the interior side panels. The case can further include lights and sound.

6 Claims, 3 Drawing Sheets

CASE FOR VISUALLY DISPLAYING A FLAG IN A REALISTIC MANNER

TECHNICAL FIELD

This invention relates generally to display cases, and this invention specifically relates to a case for visually displaying a flag in a realistic manner which provides an illustion that the flag is kept aloft in the wind.

BACKGROUND OF THE INVENTION

Display cases have previously been utilized for the purpose of storing and displaying flags. Prior efforts to provide such display cases are generally described in U.S. Pat. No. 4,879,145, to McLellan et al. and U.S. Pat. No. 5,056,657, to Frye, both of which are incorporated herein by reference. The devices described in each of these references generally function to store and display a memorial flag which is given to the family of a deceased military service person.

Because of the nature of the flags stored by the devices described in these references, namely folded memorial flags, these devices do not include a means for displaying the flags, in a realistic manner, such as when a flag is flown from a flag pole, for symbolic or patriotic purposes. An additional device, which may be utilized for displaying a banner, is described in U.S. Pat. No. 4,998,364, to Sengstaken, also incorporated herein by reference. This device provides the illusion that a miniature airplane model is pulling a curved banner with a message thereon.

Because of the popularity and widespread practice of displaying flags for primarily symbolic and patriotic purposes at, for example, schools, courthouses, and places of business, there is a need in the flag display industry for a case for visually displaying a flag in a realistic manner which provides an illusion that the flag is kept aloft in the wind.

SUMMARY OF THE INVENTION

The present invention fulfills the need in the art. Broadly described, the present invention provides a case for visually displaying a flag in a realistic manner which provides an illusion that the flag is kept aloft in the wind.

Generally described, the present invention provides a case for displaying a flag in a realistic manner, comprising a box having an elongated, flat, substantially rectangular front panel constructed from a substantially opaque material and including a substantially transparent viewing section positioned substantially in the center of the front panel; a flag pole mounted within the box to an elongated, flat, substantially rectangular base panel having a first end and a second end opposite one another; a flag attached to the flag pole and positioned so as to be visible through the transparent viewing section of the front panel; and means for creating an illusion that the flag is being kept aloft by wind.

In a preferred embodiment of the present invention, the box comprises an elongated, flat, substantially rectangular cover panel having a width and depth substantially identical to the width and depth of the base panel, the cover panel having a first end and a second end opposite one another; a pair of elongated, flat, substantially rectangular side panels of substantially identical height and depth, each of the rectangular side panels having a top edge and a bottom edge, the top edges mounted to the cover panel at the first end and the second end of the cover panel and the bottom edges mounted to the base panel at the first end and the second end of the base panel such that the base panel, side panels, and cover panel form a substantially rectangular frame having front edges and rear edges; the front panel mounted to the front edges of the frame; and an elongated, flat, substantially rectangular rear panel having a width and height substantially identical to the height of the front panel, the rear panel removably mounted to the rear edges of the frame, the rear panel including a front face on which is displayed a background scene.

In a preferred embodiment, the illusion creating means comprises an interior frame comprising an interior side panel mounted to the base panel of the frame and having an opening positioned at substantially the same height as the positioning of the flag on the flagpole; an interior cover panel mounted to the interior side panel; and a fan mounted to the interior side panel of the interior frame and positioned at substantially the same height as the opening of the interior side panel.

In a preferred embodiment, the invention also comprises illuminating means, comprising a light mounted to the interior frame.

In an alternative embodiment, the illuminating means comprises a light mounted to the frame.

In an alternative embodiment of the present invention, the display case further includes a means for producing an auditory effect, either live or pre-recorded, such as by a tape player, compact disc player, microphone, public address system, or speech synthesis integrated circuit. The auditory effect may include music, such as, for example, the National Anthem and other patriotic melodies, or speech, such as, for example, the Pledge of Allegiance, or other sound effects, such as the sound of the wind blowing through trees.

Accordingly, it is an object of the present invention to provide a case for displaying a flag in a realistic manner which provides an illusion that the flag is kept aloft in the wind.

This and other objects, features, and advantages of the present invention may be more clearly understood and appreciated from a review of the following detailed description of the disclosed embodiment and by reference to the appended drawings and claims.

BRIEF DESCRIPTION OF THE DRAWING FIGURES

DETAILED DESCRIPTION OF THE PREFERRED EMBODIMENT

Figure 1:
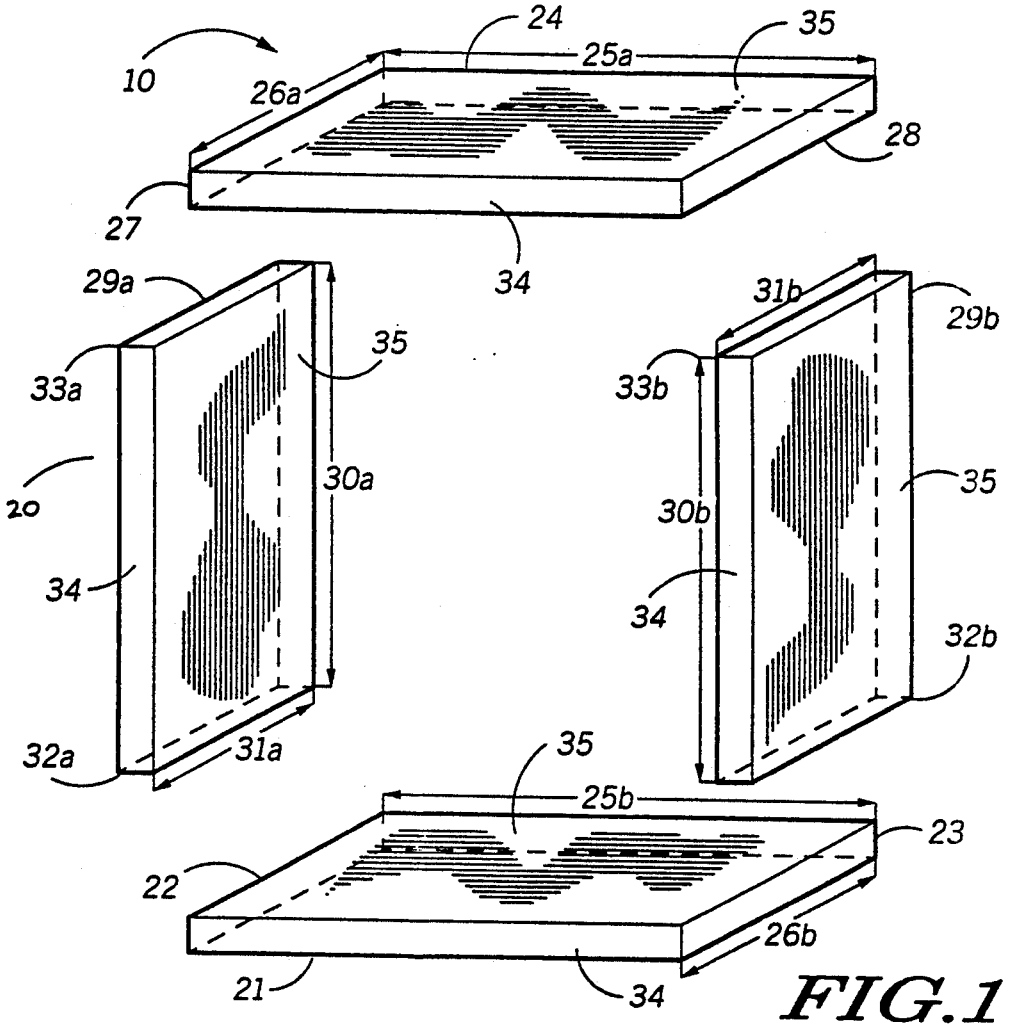
FIG. 1 is a perspective view of the frame portion of the box of the present invention.

Referring now to the drawings, in which like numerals indicate like elements throughout the several views, FIG. 1 is a perspective view of the frame portion 20 of the box 40 (illustrated in an assembled configuration in FIG. 5) of the display case 10 of the present invention. The frame 20 is comprised of a rectangular base panel 21 having a first end 22 and a second end 23 opposite one another, a rectangular cover panel 24 having a width 25*a* and depth 26*a* substantially identical to the width 25*b* and depth 26*b* of the base panel 21 and a first end 27 and a second end 28 opposite one another, and a pair of rectangular side panels 29*a*, 29*b* having identical height 30*a*, 30*b* and depth 31*a*, 31*b*. The side panels 29*a*, 29*b* each have a bottom edge 32*a*, 32*b* and a top edge 33*a*, 33*b*. The bottom edges 32*a*, 32*b* are mounted to the first end 22 and second end 23 of the base panel 21 and the top edges 33*a*, 33*b* are mounted to the first end 27 and the second end 28 of the cover panel 24. The frame 20 includes front edges 34 and rear edges 35, to which a front panel 60 and rear panel 70 are respectively mounted, as discussed with regard to FIG. 2 and FIG. 3.

Figure 2:
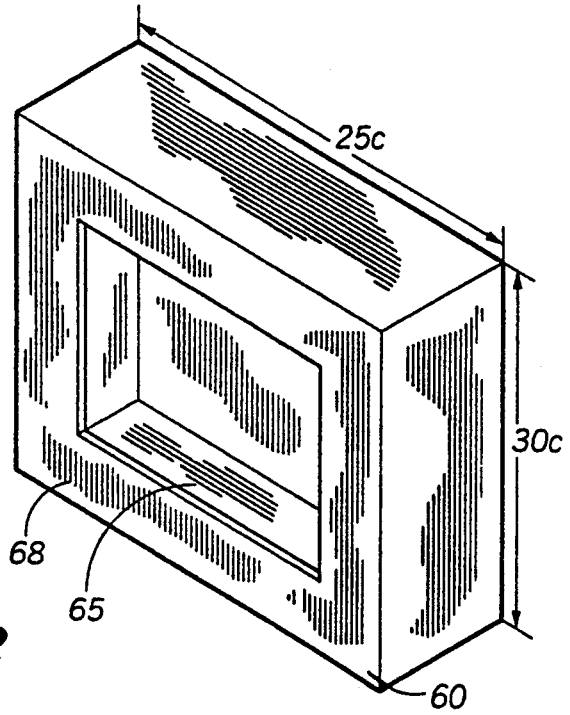
FIG. 2 is a perspective view of the front panel of the box of the present invention.

FIG. 2 is a perspective view of the front panel 60 of the box 40 of the present invention. The front panel 60, along with the base panel 21, side panels 29*a*, 29*b*, and cover panel 24, is constructed from substantially opaque material, such as, without limitation, wood, metal, plastic, or combinations thereof. A transparent viewing section 65 is positioned in the center of the front panel 60. The remainder of the front panel 60, because of the opaque nature of the material from which the front panel 60 is constructed, comprises an opaque section 68 which prevents the interior workings of the display case 10 from being observed. The transparent viewing section 65 consists of either plastic, glass, or other substantially transparent materials. The height 30*c* of the front panel 60 is virtually identical to the height 30*a*, 30*b* of the side panels 29*a*, 29*b* and the width 25*c* of the front panel is virtually identical to the width 25*a*, 25*b* of the cover panel 24 and base panel 21.

Figure 3:
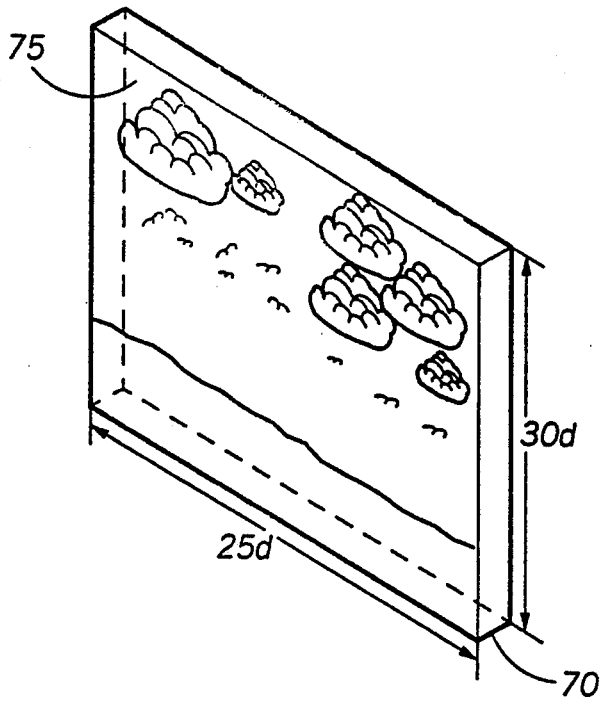
FIG. 3 is a perspective view of the rear panel of the box of the present invention.

FIG. 3 is a perspective view of the rear panel 70 of the box 40 of the present invention. The height 30*d* of the rear panel 70 is virtually identical to the height 30*a*, 30*b* of the side panels 29*a*, 29*b* and the width 25*d* of the rear panel 70 is virtually identical to the width 25*a*, 25*b* of the cover panel 24 and base panel 21. The rear panel 70 includes a front face 75, on which appears a visual background scene, such as, for example, a picture including the sun, clouds, and sky. The rear panel 70 is removably mounted to the rear edges 35 of the frame 20. Mounting of the rear panel 70 to the rear edges 35 of the frame 20 may be accomplished by a variety of ways, such as the use of a first strip of adhesive hook and loop material (not shown) attached to the rear panel 70 and a second strip of adhesive hook and loop material (not shown), complementary to the first strip of adhesive hook and loop material, attached to the rear edges 35 of the frame 20, such that the first and second strips of adhesive hook and loop material removably adhere to one another. Alternatively, the rear panel 70 may be received in a channel (not shown) of the rear edges 35, such that the rear panel 70 is mounted to the rear edges 35 of the frame 20 by sliding the rear panel 70 into the channel of the rear edges 35. It will be understood by those skilled in the relevant art that numerous other methods exist for removably mounting the rear panel 70 to the rear edges 35 of the frame.

Figure 4:
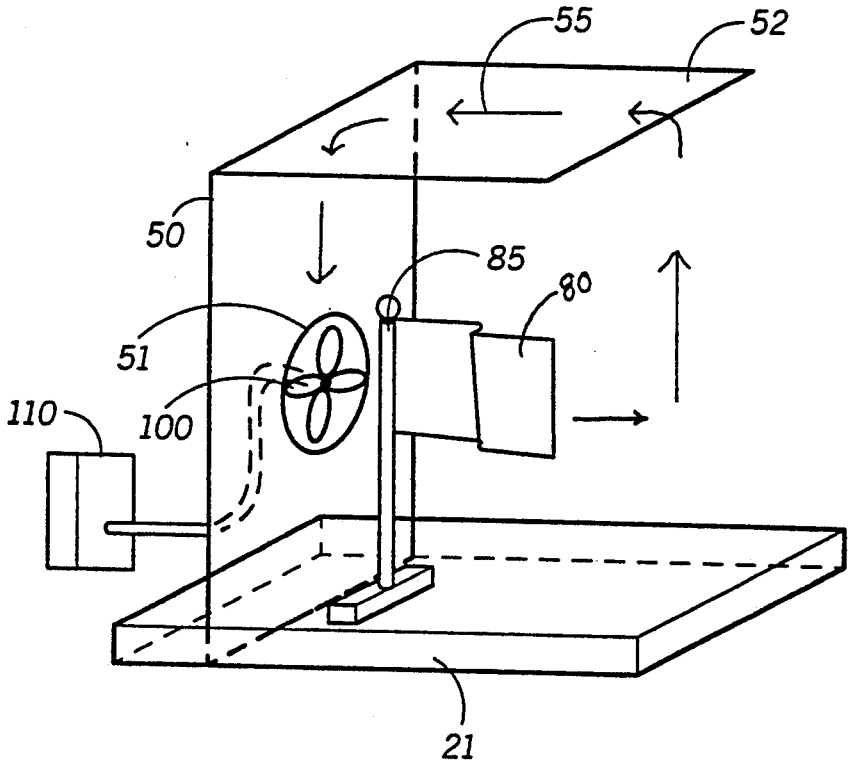
FIG. 4 is a perspective view of the relationship between the flag and illusion creating means of the present invention.

FIG. 4 is a perspective view of the relationship between the flag 80 and the illusion creating means of the present invention. The flag 80, which is manufactured from cloth or other lightweight material which may easily be directed by circulating air, is attached to a somewhat rigid flagpole 85, preferably manufactured from wood, metal, plastic, or a combination thereof. The flag 80 may be that of a nation, state, or any institution utilizing a flag as a symbol. The illusion creating means comprises an interior side panel 50 mounted to the base panel 21 of the frame 20. The interior side panel 50 has an opening 51 positioned at approximately the same height as the height at which the flag 80 is attached to the flagpole 85. A fan 100 is mounted to the side panel 50 and is connected to a power source 110, such as a battery or an electrical outlet. A switch (not shown) is attached to the power source, for activating the fan 100. The interior side panel 50 is stabilized by an interior cover panel 52 mounted to the interior side panel 50. When the box 40 is fully assembled, the opaque section 68 of the front panel 60 prevents the interior panels 50, 52, along with the fan 100 and other interior elements of the display case 10 which are not intended to be viewed, from being observed, and the transparent section 65 of the front panel 60 allows the flag 80 and the background scene on the front face 75 of the rear panel 70 to be viewed, as intended.

Operation of the illusion creating means is as follows. The switch is placed in an "on" position in order to activate the fan 100. The fan circulates the air within the box in the direction of the arrows 55 shown in FIG. 4 and FIG. 5. As the circulated air passes by the flag 80, the flow of the air causes the flag 80 to lift and extend outwardly in the direction of the air flow, creating the illusion that the flag 80 is "blowing in the wind". The illusion is illustrated in FIG. 6, a pictorial view of the preferred embodiment of the flag display device 10 of the present invention.

Figure 5:
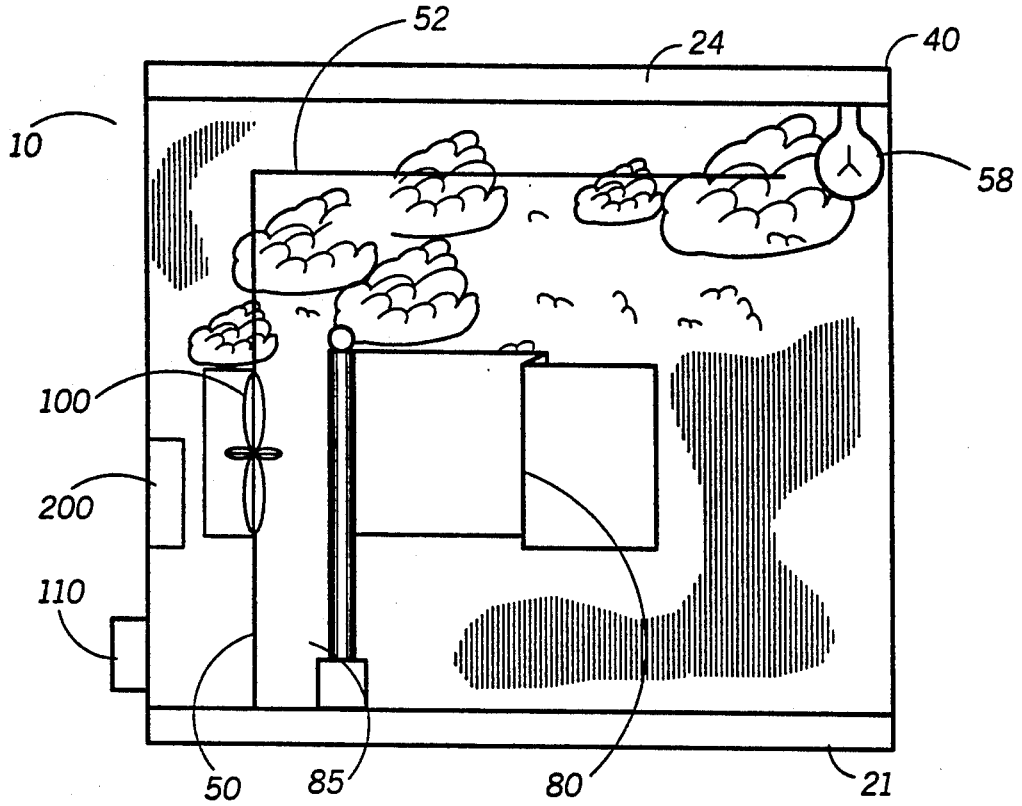
FIG. 5 is a pictorial view of the preferred embodiment of the present invention, with the front panel of the box removed.
Figure 6:
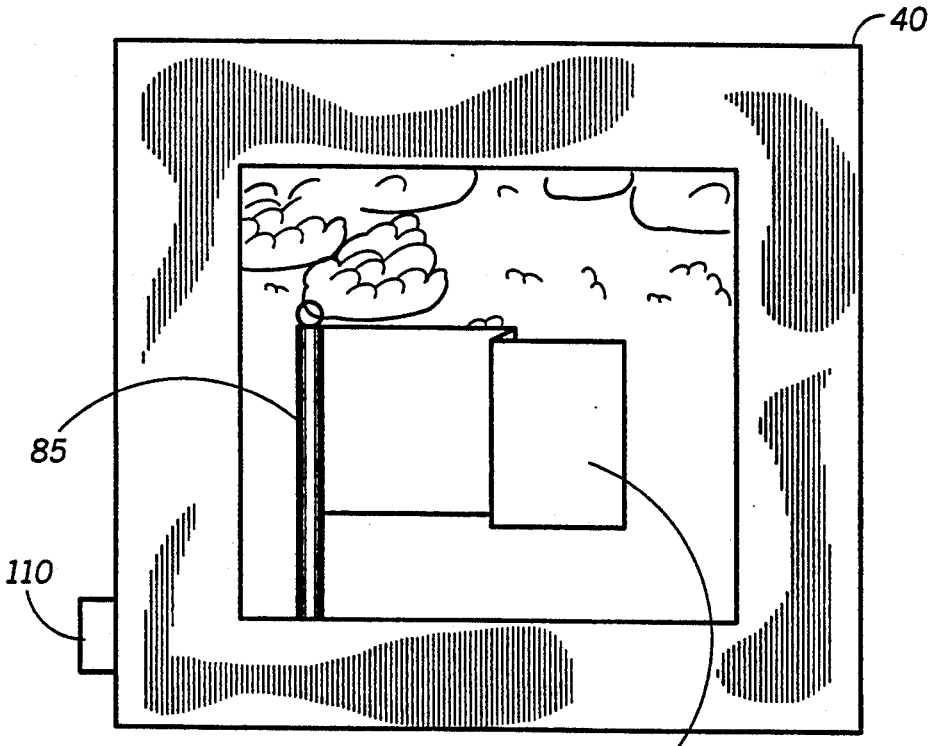
FIG. 6 is a pictorial view of the preferred embodiment of the present invention, with the front panel of the box in place.

In the preferred embodiment of the present invention, illuminating means, such as a light 58, is mounted to the interior side panel 50 or the interior cover panel 52, as shown in FIG. 5. The light is preferably connected to the same power supply 110 and switch as the fan 100, so that when the switch is placed in the "on" position, the light 58 illuminates the flag 80, creating the illusion that the sun is shining on the flag 80. In an alternative embodiment of the present invention, the illuminating means are mounted to the frame portion 20.

In an alternative embodiment of the present invention, the display case 10 further includes a means 200 for producing an auditory effect, either live or prerecorded, such as by a tape player, compact disc player, microphone, public address system, or speech synthesis integrated circuit. The auditory effect may include music, such as, for example, the National Anthem and other patriotic melodies, or speech, such as, for example, the Pledge of Allegiance, or other sound effects, such as the sound of the wind blowing through trees.

Accordingly, it will be understood that both the preferred and alternative embodiments of the present invention have been disclosed by way of example and that other modifications and alterations may occur to those skilled in the art without departing from the scope and spirit of the appended claims.

What is claimed is:

1. A case for visually displaying a flag in a realistic manner, comprising:

a box having an elongated, flat, substantially rectangular front panel constructed from a substantially opaque material and including a substantially transparent viewing section positioned substantially in the center of said front panel;

a flag pole mounted within said box to an elongated, flat, substantially rectangular base panel having a first end and a second end opposite one another;

a flag attached to said flag pole and positioned so as to be visible through said transparent viewing section of said front panel; and means for creating an illusion that said flag is being kept aloft by wind, said illusion creating means comprising an interior frame comprising:

an interior side panel mounted to said base panel of said frame, said interior side panel having an opening positioned at substantially the same height as the positioning of said flag on said flagpole;

an interior cover panel mounted to said interior side panels; and a fan mounted to said interior side panel and positioned at substantially the same height as said opening of said interior side panel.

2. The display case of claim 1, wherein said box further comprises an elongated, flat, substantially rectangular cover panel having a width and depth substantially identical to the width and depth of said base panel, said cover panel having a first end and a second end opposite one another;

a pair of elongated, flat, substantially rectangular side panels of substantially identical height and depth, each of said rectangular side panels having a top edge and a bottom edge, said top edges mounted to said cover panel at said first end and said second end of said cover panel and said bottom edges mounted to said base panel at said first end and said second end of said base panel such that said base panel, side panels, and cover panel form a substantially rectangular frame having front edges and rear edges;

said front panel having a height substantially identical to the height of said side panels and a width substantially identical to the width of said base panel, said front panel mounted to said front edges of said frame; and an elongated, flat, substantially rectangular rear panel having a width and height substantially identical to the height of said front panel, said rear panel removably mounted to said rear edges of said frame, said rear panel including a front face on which is displayed a background scene.

3. The display case of claim 1, further comprising illuminating means.

4. The display case of claim 3, wherein said illuminating means comprises a light.

5. The display case of claim 1, further comprising means for producing an auditory effect.

6. The display case of claim 5, wherein said producing means comprises a device by which sound effects may be heard.

* * * * *